US009869217B2

(12) United States Patent
Fukuoka et al.

(10) Patent No.: US 9,869,217 B2
(45) Date of Patent: Jan. 16, 2018

(54) OIL CIRCULATION DEVICE FOR INTERNAL COMBUSTION ENGINE

(71) Applicant: HONDA MOTOR CO., LTD., Tokyo (JP)

(72) Inventors: Kazuya Fukuoka, Wako (JP); Rie Nagai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 130 days.

(21) Appl. No.: 14/789,988

(22) Filed: Jul. 2, 2015

(65) Prior Publication Data

US 2016/0003112 A1 Jan. 7, 2016

(30) Foreign Application Priority Data

Jul. 3, 2014 (JP) ..... 2014-137688

(51) Int. Cl.
*F01M 11/00* (2006.01)

(52) U.S. Cl.
CPC . *F01M 11/0004* (2013.01); *F01M 2011/0041* (2013.01)

(58) Field of Classification Search
CPC ..... F01M 11/0004; F01M 2011/0041
USPC ..... 123/196 A
See application file for complete search history.

(56) References Cited

U.S. PATENT DOCUMENTS 6,796,283 B1 * 9/2004 Fleury ..... F01M 11/0004 123/195 C
2003/0079943 A1 * 5/2003 Suratt ..... F02B 77/04 184/1.5
2004/0135321 A1 * 7/2004 Rehr ..... F01M 11/0004 277/592
2009/0277416 A1 * 11/2009 Saito ..... F01M 11/0004 123/196 AB
2010/0031915 A1 * 2/2010 Riedel ..... F01M 11/0004 123/196 R
2011/0147128 A1 * 6/2011 Schrade ..... B29C 45/22 184/106

FOREIGN PATENT DOCUMENTS

JP 53-28339 U 3/1978
JP 62-16711 * 7/1985 ..... F01M 11/00
(Continued)

OTHER PUBLICATIONS

Japanese Office Action for corresponding JP Application No. 2014-137688, dated Mar. 1, 2016 (w/ English machine translation).

*Primary Examiner* — Joseph Dallo
*Assistant Examiner* — Yi-Kai Wang
(74) *Attorney, Agent, or Firm* — Mori & Ward, LLP

(57) ABSTRACT

An oil circulation device for an internal combustion engine includes an oil pan, a partition, and a communication groove. The oil pan is disposed below a cylinder block and includes a bottom wall and a sidewall to define a recessed portion that opens upward. The partition extends upward from the bottom wall so as to have a protruding end and divide the recessed portion into a first recessed portion and a second recessed portion. The communication groove extends downward from the protruding end of the partition in a thickness direction of the partition to connect the first recessed portion and the second recessed portion.

18 Claims, 8 Drawing Sheets

(56) References Cited

FOREIGN PATENT DOCUMENTS

| | | | | |
|---|---|---|---|---|
| JP | 62-16711 | * | 1/1987 | ..... F01M 11/00 |
| JP | 62-16711 U | | 1/1987 | |
| JP | 05-57306 U | | 7/1993 | |
| JP | 5-57306 U | | 7/1993 | |
| JP | 7-83112 | | 3/1995 | |
| JP | 11-229841 | | 8/1999 | |
| JP | 2012-154225 | | 8/2012 | |

* cited by examiner

OIL CIRCULATION DEVICE FOR INTERNAL COMBUSTION ENGINE

CROSS-REFERENCE TO RELATED APPLICATIONS

The present application claims priority under 35 U.S.C. §119 to Japanese Patent Application No. 2014-137688, filed Jul. 3, 2014, entitled "Oil Circulation Device for Internal Combustion Engine." The contents of this application are incorporated herein by reference in their entirety.

BACKGROUND

1. Field

The present disclosure relates to an oil circulation device for an internal combustion engine.

2. Description of the Related Art

In internal combustion engines, an oil circulation device in which an oil pan for storing oil is provided in the lower portion of the internal combustion engine body and which transports, by using an oil pump, oil in the oil pan to sliding parts (crankshaft, camshaft, piston) of the internal combustion engine is widely used.

In such an oil circulation device, because a displacement of the oil in the oil pan occurs due to, for example, an inertial force at the time of acceleration/deceleration of a vehicle, a centrifugal force at the time of turning, or inclination of the road surface, a device that keeps a suction mouth of the oil pump always inside the oil is necessary. For example, in an oil circulation device according to Japanese Unexamined Utility Model Registration Application Publication No. 5-57306, two separate recessed portions are formed in the bottom portion of the oil pan and the respective bottom portions of the individual recessed portions are connected to each other by a communication pipe. Then, a strainer that constitutes the oil pump suction mouth is arranged in one of the two recessed portions. According to this configuration, when oil subjected to an inertial force or the like moves, because the inside of the oil pan is divided into two recessed portions, the amount of movement (displacement) of the oil is reduced, and it becomes easy to maintain the oil pump suction mouth inside the oil (below the oil surface). Moreover, because the two recessed portions are connected at their bottom portion by the communication pipe, the heights of the oil surfaces of the two recessed portions are constantly maintained equal to each other.

SUMMARY

According to one aspect of the present invention, an oil circulation device for an internal combustion engine includes an oil pan, a partition, and a communication groove. The oil pan is disposed below a cylinder block and includes a bottom wall and a sidewall that form a recessed portion that opens upward. The partition extends upward from the bottom wall so as to divide the recessed portion into a first recessed portion and a second recessed portion. The communication groove is recessed downward from the protruding end of the partition, penetrates the partition in the thickness direction, and enables communication between the first recessed portion and the second recessed portion.

According to another aspect of the present invention, an oil circulation device for an internal combustion engine includes an oil pan, a partition, and a communication groove. The oil pan is disposed below a cylinder block and includes a bottom wall and a sidewall to define a recessed portion that opens upward. The partition extends upward from the bottom wall so as to have a protruding end and divide the recessed portion into a first recessed portion and a second recessed portion. The communication groove extends downward from the protruding end of the partition in a thickness direction of the partition to connect the first recessed portion and the second recessed portion.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
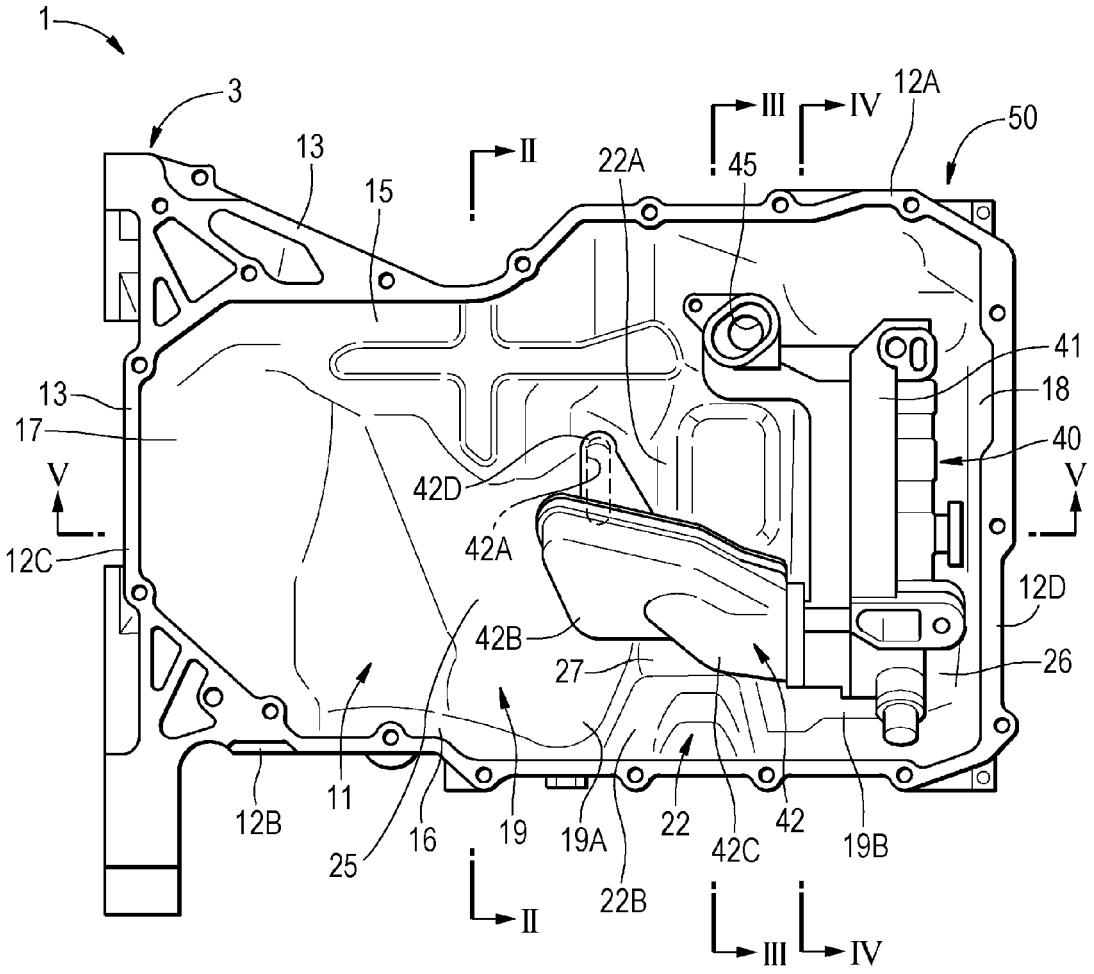
FIG. 1 is a plan view of an oil circulation device according to an embodiment.

The embodiments will now be described with reference to the accompanying drawings, wherein like reference numerals designate corresponding or identical elements throughout the various drawings.

An oil circulation device for an internal combustion engine of a motor vehicle according to an embodiment of the present disclosure will be described below with reference to the drawings. In the following description, individual directions are established for a standard motor vehicle in which an internal combustion engine is installed. The internal combustion engine according to this embodiment is arranged across the motor vehicle so that the cylinder bank is made to extend in the left-right direction (width direction).

Figure 3:
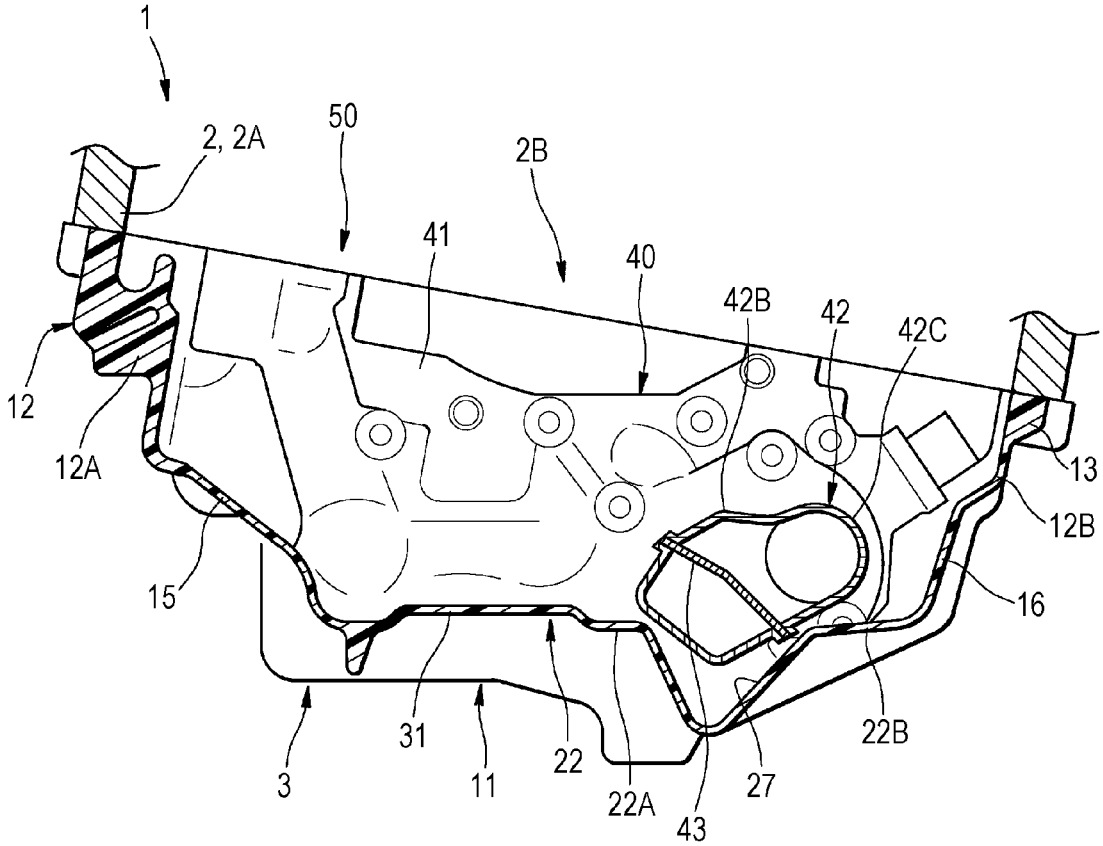
FIG. 3 is a cross-sectional view taken along III-III of FIG. 1.
Figure 4:
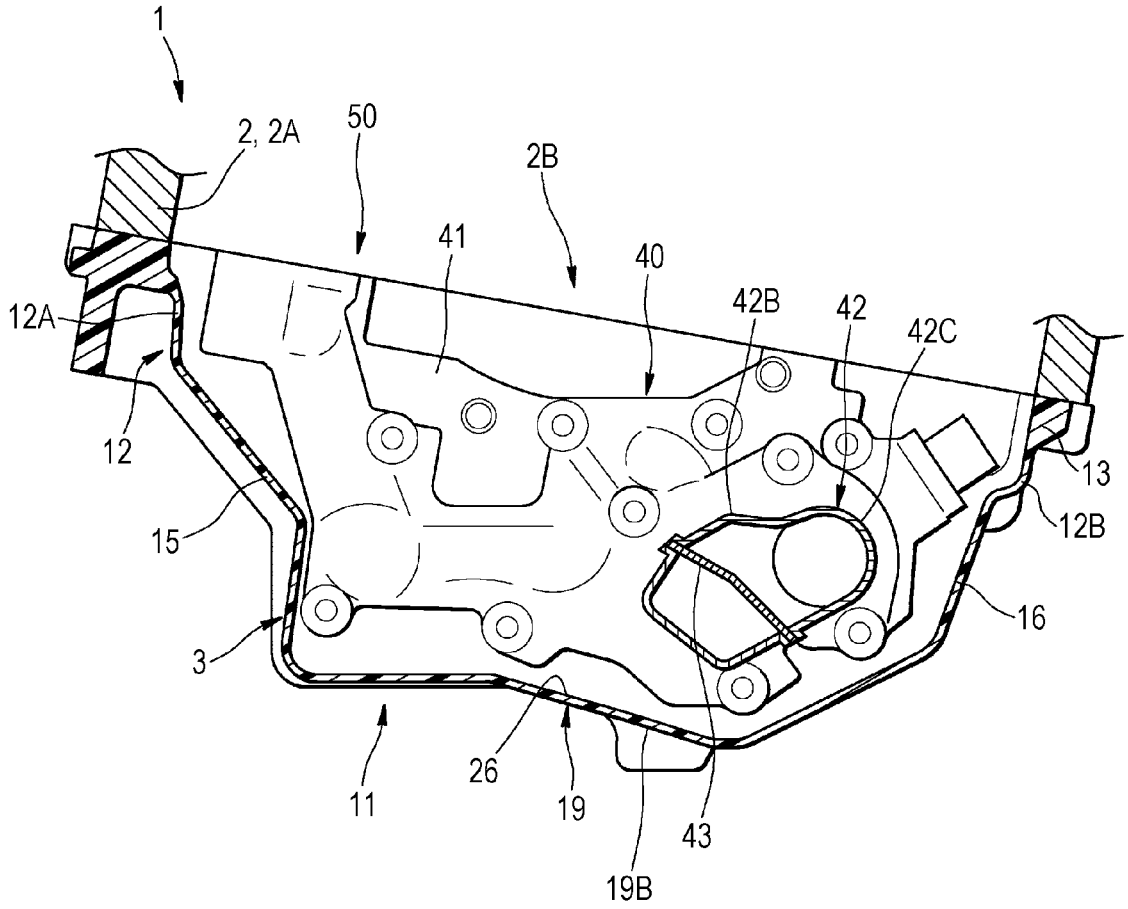
FIG. 4 is a cross-sectional view taken along IV-IV of FIG. 1.
Figure 5:
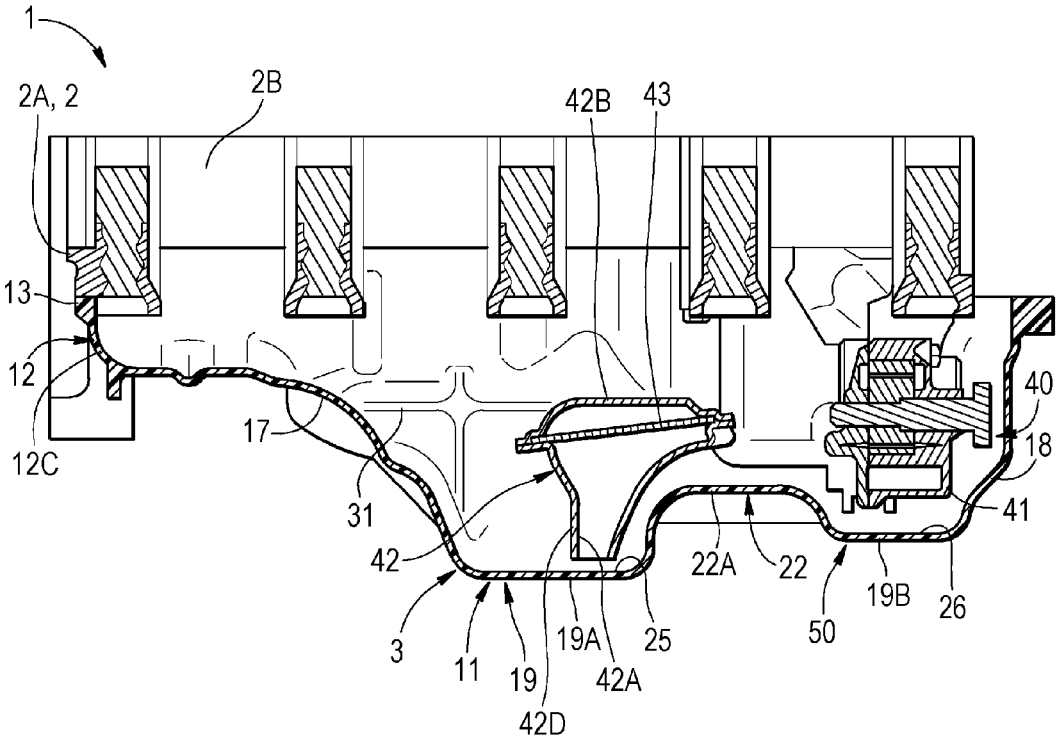
FIG. 5 is a cross-sectional view taken along V-V of FIG. 1.

FIGS. 1 to 5 illustrate an oil circulation device 50 according to an embodiment, and FIGS. 6 to 9 illustrate only an oil pan 3 of the oil circulation device 50. As illustrated in FIGS. 2 to 5, an internal combustion engine 1 includes a cylinder block 2 and the oil pan 3 which is provided below the cylinder block 2. The cylinder block 2 includes an upper block (not illustrated) which has cylinders (not illustrated) formed therein and which constitutes the upper portion of the cylinder block 2, and a lower block 2A which is coupled to the lower end of the upper block. As illustrated in FIG. 5, the lower block 2A has a ladder frame structure and has a shaft bearing which is located between the lower block 2A and the upper block and which rotatably supports the crankshaft (not illustrated). The lower portion of the cylinder block 2 forms the crank chamber 2B which is open downward.

As illustrated in FIGS. 1 to 9, the oil pan 3 includes a bottom wall 11 and a sidewall 12 constituted by a front sidewall 12A, a rear sidewall 12B, a left sidewall 12C, and a right sidewall 12D standing along the edge of the bottom wall 11, and forms a box that has a recessed portion that opens upward. At the upper edge of the front sidewall 12A, the rear sidewall 12B, the left sidewall 12C, and the right sidewall 12D, a flange 13 extends toward the outer side of the oil pan 3 and forms an approximate right angle with respect to each of the walls. The flange 13 is connected to the lower end of the lower block 2A by using a bolt fastening or the like, and is provided in such a manner as to enable the oil pan 3 to close the crank chamber 2B. The oil pan 3 is connected to the cylinder block 2 and forms the lower end portion of the internal combustion engine 1.

Figure 6:
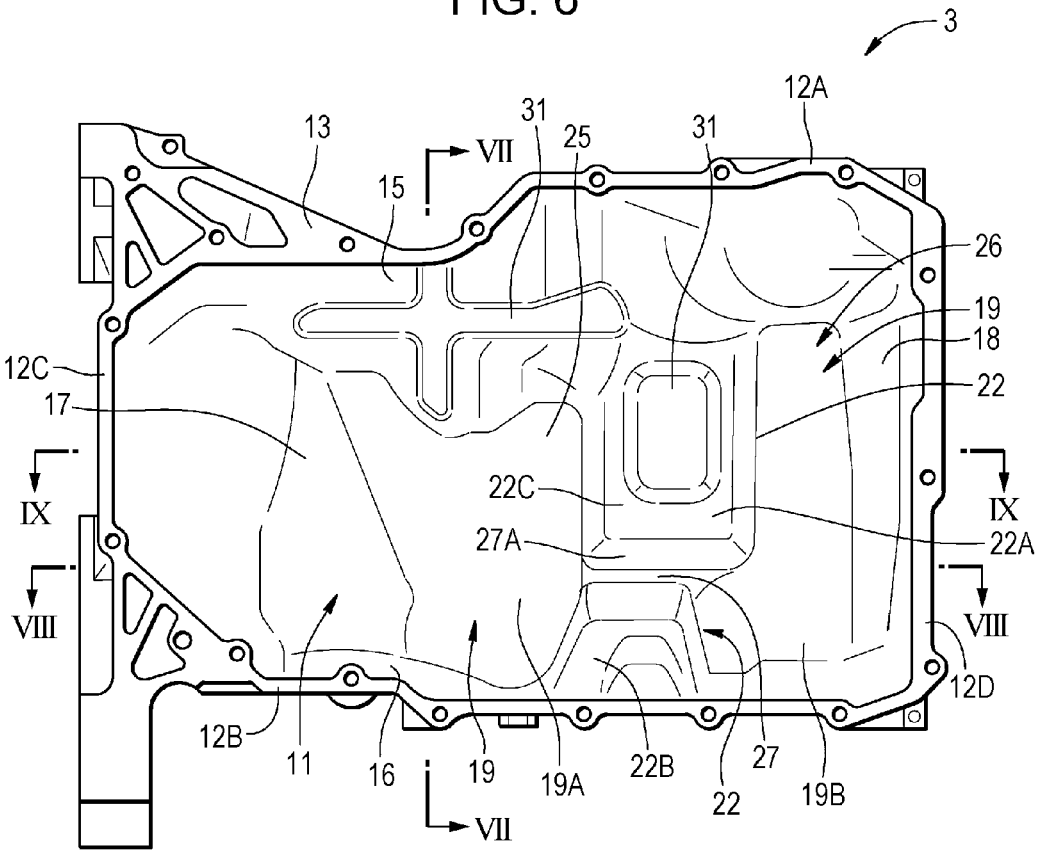
FIG. 6 is a plan view of an oil pan of an oil circulation device according to an embodiment.

As illustrated in FIG. 6, the bottom wall 11 of the oil pan 3 is formed so as to be longer in the left-right direction than in the front-rear direction. A bottom wall front portion 15, which is the front portion of the bottom wall 11, extends in the left-right direction and is inclined upward toward the front. A bottom wall rear portion 16, which is the rear portion of the bottom wall 11, extends in the left-right direction and is inclined upward toward the rear. A bottom wall left portion 17, which is the left-side portion of the bottom wall 11, extends in the front-rear direction and is inclined upward toward the left. A bottom wall right portion 18, which is the right-side portion of the bottom wall 11, extends in the front-rear direction and is inclined upward toward the right. The central portion of the bottom wall 11 which is surrounded by the bottom wall front portion 15, the bottom wall rear portion 16, the bottom wall left portion 17, and the bottom wall right portion 18 constitutes the bottom wall lower portion 19. The bottom wall 11 is arranged so that the bottom wall lower portion 19 is lower than the peripheral portion of the bottom wall 11, and has a recessed shape which is recessed downward.

The bottom wall left portion 17 is longer in the left-right direction than the bottom wall right portion 18 and the bottom wall lower portion 19 is arranged at a position that is deviated to the right of the center of the bottom wall 11 in the left-right direction. Moreover, the bottom wall front portion 15 is longer in the front-rear direction than the bottom wall rear portion 16 and the bottom wall lower portion 19 is arranged at a position that is deviated to the rear of the center of the bottom wall 11 in the front-rear direction.

Figure 8:
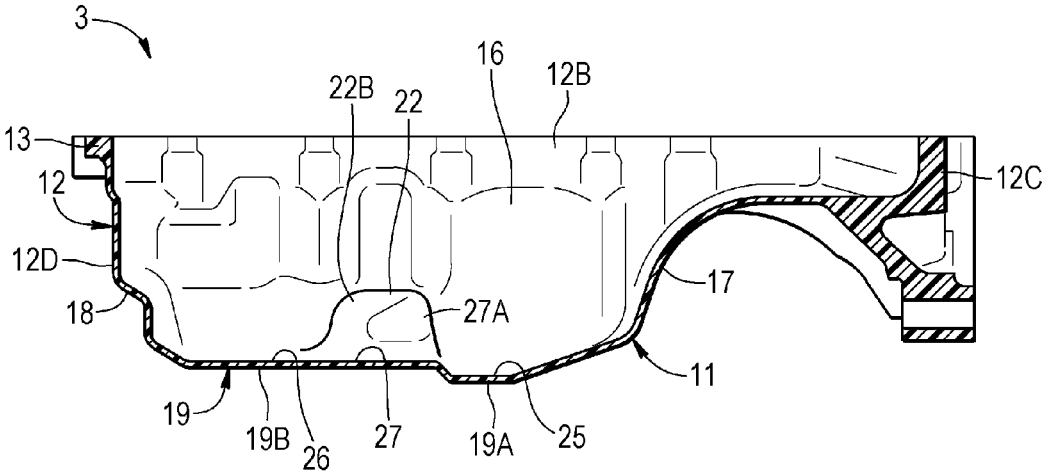
FIG. 8 is a cross-sectional view taken along VIII-VIII of FIG. 6.
Figure 9:
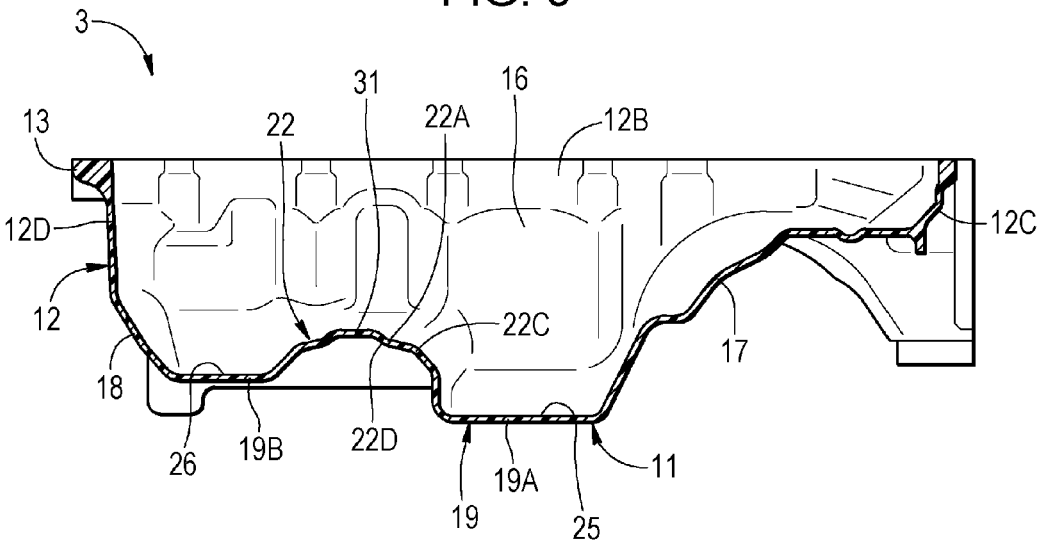
FIG. 9 is a cross-sectional view taken along IX-IX of FIG. 6.

As illustrated in FIGS. 8 and 9, a lower left bottom wall 19A, which is the left half portion of the bottom wall lower portion 19, is arranged lower than a lower right bottom wall 19B, which is the right half portion of the bottom wall lower portion 19. As illustrated in FIGS. 6 and 9, a partition 22 that protrudes upward is provided on the border between the lower left bottom wall 19A and the lower right bottom wall 19B. The front end of the partition 22, which extends in the front-rear direction, is connected to the bottom wall front portion 15 and the rear end of the partition 22 is connected to the bottom wall rear portion 16. The upper end of the partition 22 (protruding end) is located at a middle position of each of the bottom wall front portion 15 and the bottom wall rear portion 16 in the up-down direction. That is, the height of the partition 22 is smaller than that of the bottom wall front portion 15 and the bottom wall rear portion 16. The partition 22 has a specific width in the left-right direction.

Due to the partition 22, in the bottom wall 11 of the oil pan 3, a first recessed portion 25 which is enclosed by the left portion of the bottom wall front portion 15, the bottom wall left portion 17, the left portion of the bottom wall rear portion 16 and the partition 22 and which has the lower left bottom wall 19A as its bottom, and a second recessed portion 26 which is enclosed by the right portion of the bottom wall front portion 15, the bottom wall right portion 18, the right portion of the bottom wall rear portion 16 and the partition 22 and which has the lower right bottom wall 19B as its bottom are formed. The lower left bottom wall 19A is arranged lower than the lower right bottom wall 19B, and the first recessed portion 25 is formed so as to be deeper than the second recessed portion 26.

Figure 7:
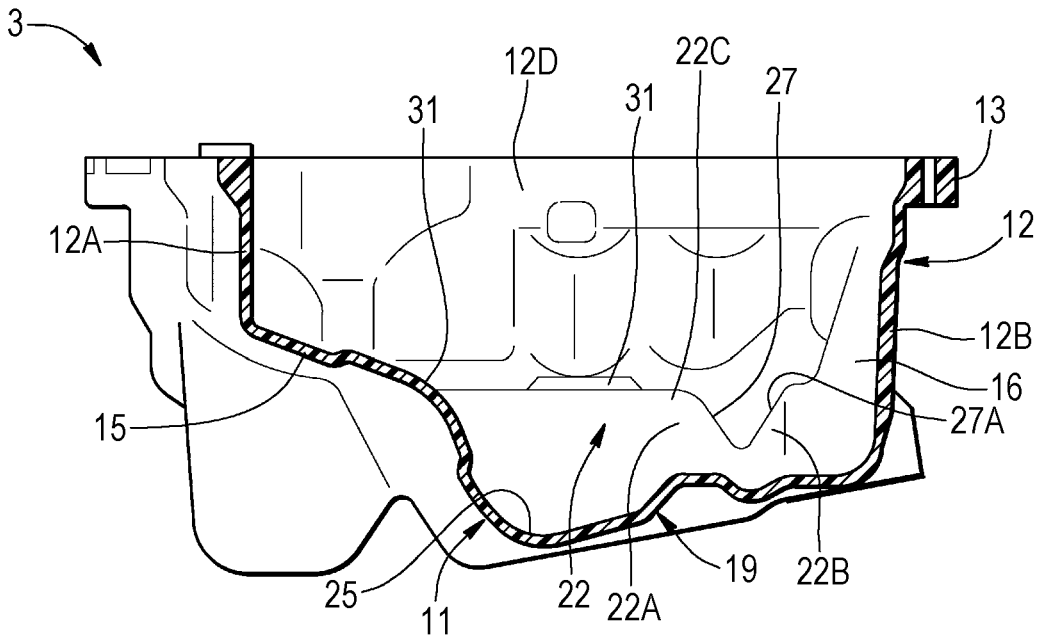
FIG. 7 is a cross-sectional view taken along VII-VII of FIG. 6.

As illustrated in FIGS. 6 and 7, a communication groove 27 that extends through the partition 22 in the left-right direction is formed in the partition 22. The communication groove 27 is a drain that is recessed vertically down from the upper end surface of the partition 22, that extends in the left-right direction and that enables the first recessed portion 25 and the second recessed portion 26 to communicate with each other. Moreover, the partition 22 is divided by the communication groove 27 into a front partition 22A that is arranged in a front portion of the partition 22 and a rear partition 22B which is arranged in a rear portion of the partition 22. In the present embodiment, the cross section of the communication groove 27 is formed as an inverted triangle so as to taper toward the bottom side.

As illustrated in FIGS. 6 to 9, the front partition 22A and the rear partition 22B each protrude upward and are formed by the partition outer portion 22C which forms the hollow portion 22D which is open downward toward the inner side. The partition outer portion 22C extends in the front-rear direction. The communication groove 27 protrudes downward in such a manner that the partition outer portion 22C is recessed downward, and is formed by the communication groove outer portion 27A that extends in such a manner so as to cross the thickness direction (left-right) of the partition outer portion 22C.

The bottom portion of the communication groove 27 is arranged, in the up-down direction, at a position (height) the same as that of the upper surface of the lower right bottom wall 19B near the communication groove 27, at a position (height) the same as that of the upper surface of the lower left bottom wall 19A near the communication groove 27, or between a position of the upper surface of the lower right bottom wall 19B near the communication groove 27 and a position of the upper surface of the lower left bottom wall 19A near the communication groove 27. That is, the position of the communication groove 27 is set such that oil may flow along the communication groove 27 from the lower right bottom wall 19B to the lower left bottom wall 19A without being obstructed. As illustrated in FIG. 8, in the present embodiment, the bottom portion of the communication groove 27 is arranged, in the up-down direction, at a position (height) the same as that of the upper surface of the lower right bottom wall 19B near the communication groove 27 and is smoothly connected flush with the upper surface of the lower right bottom wall 19B near the communication groove 27. However, the bottom surface of the communication groove 27 is arranged above the upper surface of the lower left bottom wall 19A near the communication groove 27, and forms a step portion between itself and the upper surface of the lower left bottom wall 19A near the communication groove 27. The bottom portion of the communication groove 27 may alternatively extend horizontally in the left-right direction, or may be inclined downward from the lower right bottom wall 19B to the lower left bottom wall 19A.

The bottom portion of the second recessed portion 26, that is, the lower right bottom wall 19B, is formed in an inclined manner such that the portion of the lower right bottom wall 19B that connects with the communication groove 27 is its lowermost portion. Consequently, oil present in the second recessed portion 26 flows toward the communication groove 27, flows along the communication groove 27, and flows into the first recessed portion 25.

As illustrated in FIG. 6, a rib 31 for reinforcement protrudes from an appropriate portion of the bottom wall 11 of the oil pan 3 and the sidewall 12. In particular, the rib 31 may be formed in at least one of a sidewall front portion, a sidewall rear portion, a sidewall left portion, a sidewall right portion, and a partition 22. In the present embodiment, a cross-shaped rib 31 protrudes from the inside surface of a sidewall front portion, and a rectangular rib 31 protrudes from the top end surface of the partition 22.

The oil pan 3 formed as described above is not intended to be limited, and may be formed by injection molding using a resin as the raw material, or press forming using steel as the raw material. In the present disclosure, the oil pan 3 is formed by injection molding using a resin as the raw material.

Oil (engine oil) is stored inside the oil pan 3. Oil is used, for example, for the lubrication of sliding contact parts such as the crankshaft, the camshaft, and the piston, and for operation of devices such as a cam phase varying device (VTC), and a variable valve timing and lift mechanism (VTEC). In a steady state in which an external force such as an inertial force or a centrifugal force is not applied, the surface of the oil is higher than the top end surface of the partition 22.

As illustrated in FIGS. 1 to 5, an oil pump 40 that pumps oil present in the oil pan 3 to each part of the internal combustion engine 1 is arranged inside the oil pan 3. The oil pump 40 is a well-known oil pump, and in the present embodiment is a trochoid pump. The oil pump 40 includes a pump body 41 that contains an inner rotor and an outer rotor therein, and an oil suction pipe 42 that protrudes from the pump body 41.

The oil suction pipe 42 is a pipe with both ends open and has a passage formed therein. The tip end of the oil suction pipe 42 constitutes the oil suction mouth 42A which sucks oil inside the oil pan 3, and the base end of the oil suction pipe 42 is connected to the pump body 41 and is in communication with the oil passage formed inside the pump body 41.

In a middle portion of the oil suction pipe 42 in the longitudinal directional thereof, a chamber 42B, which is made wider so as to increase the cross-sectional area of the passage inner portion, is formed. The chamber portion 42B is disk shaped and has a certain thickness. The base portion 42C of the oil suction pipe 42 extends from a central portion of one surface of the chamber portion 42B along an outer surface of the chamber portion 42B. The tip portion 42D of the oil suction pipe 42, after extending from a central portion of one surface of the chamber portion 42B along an outer surface of the chamber portion 42B, bends in a direction orthogonal to the outer surface of the chamber portion 42B, and forms a tip end. Consequently, the oil suction pipe 42 is formed relatively narrow while also containing the chamber portion 42B.

As illustrated in FIGS. 3 to 5, inside the chamber portion 42B, an oil filter screen 43 is provided so as to cross the flow path. The oil filter screen 43 may be, for example, a steel mesh. Consequently, oil sucked through the oil suction mouth 42A passes through the oil filter screen 43, and, after foreign matter has been removed, flows into the pump body 41. Consequently, the oil suction pipe 42 functions as an oil strainer. The oil suction pipe 42 contains two materials which are fixed to each other, and the oil filter screen 43 is provided inside the oil suction pipe 42 by being sandwiched between these two materials.

An oil discharge mouth 45 is formed in the upper surface of the pump body 41. The oil discharge mouth 45 is connected directly to the open end of the oil gallery (not illustrated) which is formed in the cylinder block 2, or indirectly via a connection pipe.

As illustrated in FIG. 1, the pump body 41 is arranged to the right of the partition 22, that is, in a region corresponding to the second recessed portion 26. In the present embodiment, part of the lower portion of the pump body 41 protrudes into the second recessed portion 26. The pump body 41 is connected to the lower block 2A by a bolt or the like. The oil pump 40 is coupled to the crankshaft through a driving force transmission mechanism (not illustrated) that contains a sprocket and chain, and the inner rotor is rotationally driven in accordance with the rotation of the crankshaft.

Figure 2:
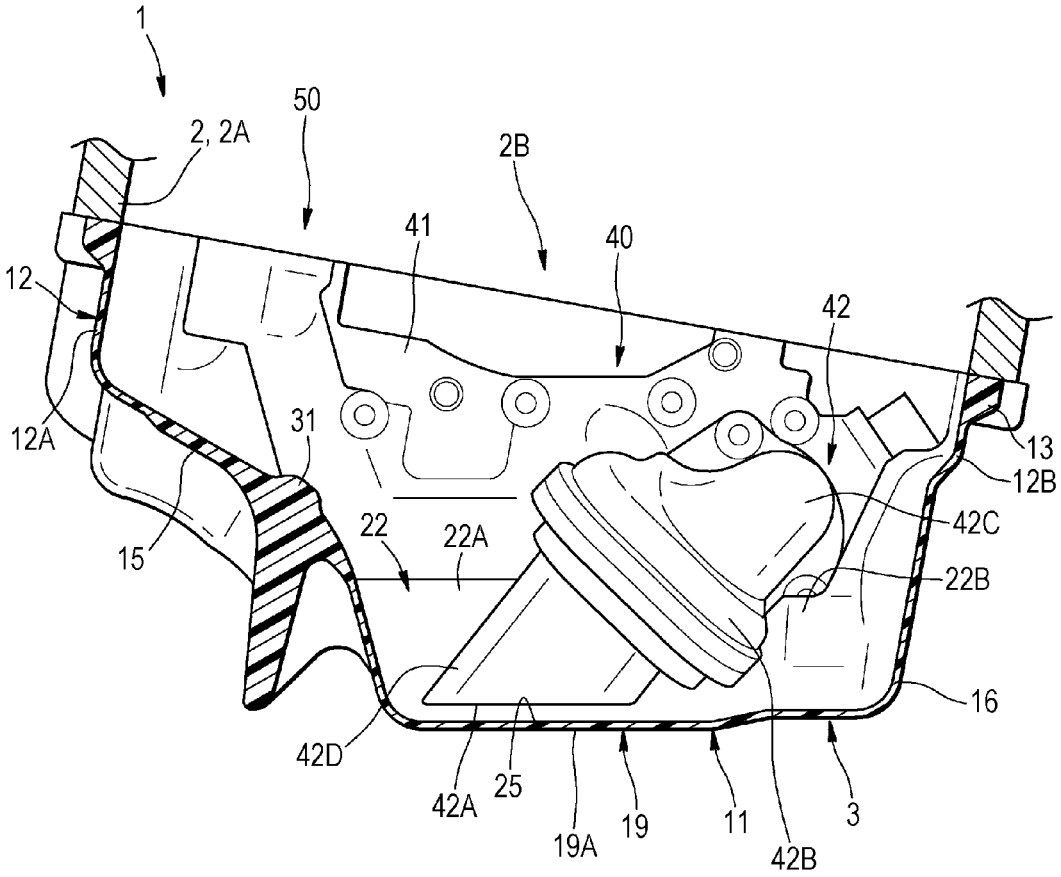
FIG. 2 is a cross-sectional view taken along II-II of FIG. 1.

As illustrated in FIGS. 1 to 5, from the base portion of the oil suction pipe 42 which is coupled to the pump body 41 in the second recessed portion 26, the oil suction pipe 42 extends above the communication groove 27 and extends to the inside of the first recessed portion 25. As illustrated in FIGS. 2 and 5, the oil suction mouth 42A provided at the tip portion of the oil suction pipe 42 is arranged so as to be opposite and near the upper surface of the lower left bottom wall 19A, which constitutes the bottom portion of the first recessed portion 25, with a certain gap therebetween. In plan view, the chamber portion 42B of the oil suction pipe 42 is arranged in a region corresponding to the communication groove 27 and the first recessed portion 25. As illustrated in FIG. 3, a part of the lower portion of the chamber portion 42B of the oil suction pipe 42 is received by the communication groove 27 (protrudes inside the communication groove 27). In other words, a part of the lower portion of the chamber portion 42B is arranged lower than the upper end surface of the partition 22 and extends inside the communication groove 27. Consequently, the cross-sectional area of the flow path of the oil formed by the communication groove 27 is reduced (narrowed) by the chamber portion 42B of the oil suction pipe 42.

An oil circulation device 50 containing the oil pan 3 and the oil pump 40 formed in the above-described manner is formed.

The effects of the oil circulation device 50 formed in the above-described manner will be described. In the oil circulation device 50 according to the present embodiment, because the inside of the oil pan 3 is divided into the first recessed portion 25 and the second recessed portion 26 by the partition 22, when oil subjected to an inertial force or the like moves horizontally inside the oil pan, the amount of movement of the oil (displacement) can be reduced. Moreover, because the first recessed portion 25 and the second recessed portion 26 are in communication with each other through the communication groove 27, it is possible for the oil to move to and fro and oil is prevented from being maldistributed to the second recessed portion 26 when in a steady state. Because the bottom portion of the first recessed portion 25 is arranged at a lower position than the bottom portion of the second recessed portion 26, and the first recessed portion 25 and the second recessed portion 26 are in communication with each other through the communication groove 27, when in a steady state, the depth of the oil is greater in the first recessed portion 25. Because the oil suction mouth 42A of the oil pump 40 is arranged in the first recessed portion 25 of the oil pan 3 formed in the above-described manner, even when oil is maldistributed in the first recessed portion 25 and the second recessed portion 26 due to an inertial force or the like, it is easy for the oil suction mouth 42A to remain in the oil and suction of air is prevented.

Because the first recessed portion 25 and the second recessed portion 26 are divided by the partition 22, and because there is a structure that enables the first recessed portion 25 and the second recessed portion 26 to communicate with each other through the communication groove 27 formed in the partition 22, it is possible to form the oil pan 3 containing the partition 22 and the communication groove 27 integrally.

Moreover, because the communication groove 27 that enables the first recessed portion 25 and the second recessed portion 26 to communicate with each other is open upwards, it is possible to form the oil pan 3 containing the partition 22 and the communication groove 27 by steel sheet press forming or resin injection molding, and manufacturing may be facilitated.

Moreover, because the bottom wall front portion 15, the bottom wall left portion 17, the bottom wall right portion 18, and the bottom wall rear portion 16 arranged in the periphery of the first recessed portion 25 and the second recessed portion 26 are inclined, oil that has entered the oil pan 3 flows into the lower left bottom wall 19A of the first recessed portion 25 and the lower right bottom wall 19B of the second recessed portion 26. Then, oil present in the second recessed portion 26 is guided toward the communication groove 27 because the lower right bottom wall 19B of the second recessed portion 26 is inclined downward toward the communication groove 27. Because the bottom portion of the communication groove 27 is arranged at the same height as the upper surface of the lower right bottom wall 19B, the flow of oil along the communication groove 27 from the second recessed portion 26 to the first recessed portion 25 is smooth and not inhibited. In the above-mentioned configuration, because oil flows down on the oil pan 3 into the first recessed portion 25, in a steady state, the depth of the oil present in the first recessed portion 25 becomes the largest inside the oil pan 3. Consequently, it is easy for the oil suction mouth 42A arranged in the first recessed portion 25 to remain in the oil.

Moreover, because the oil pump 40 includes a portion that extends inside the communication groove 27, the cross-sectional area through which the oil in the communication groove 27 may pass is reduced due to the oil pump 40. Consequently, when the oil in the first recessed portion 25 moves due to a temporary inertial force, centrifugal force, or the like, the amount of oil that flows along the communication groove 27 from the first recessed portion 25 into the second recessed portion 26 is reduced, and the amount of oil remaining in the first recessed portion 25 is increased. Consequently, it is easy for the suction mouth 42A to remain in the oil.

Moreover, the partition 22 has an effect of increasing the rigidity of the oil pan 3. Because the partition outer portion 22C and the communication groove outer portion 27A have a structure in which the bottom wall 11 of the oil pan 3 is bent, the rigidity of the oil pan 3 can be increased. The communication groove outer portion 27A reduces the deformation that occurs in the partition outer portion 22C in the thickness direction (left-right direction) of the partition 22.

Although the embodiment has been described in detail above, the present disclosure is not limited to the embodiment and various modifications are possible. In the above-described embodiment, the partition 22 is formed so as to extend in the front-rear direction, however, in another embodiment, the partition 22 may extend in any direction such as the left-right direction. Moreover, in the above-described embodiment, there is a single partition 22 that includes the front partition 22A and the rear partition 22B, however, in another embodiment, there may be a plurality of partitions 22. In this case, the plurality of partitions 22 may include a portion at which they intersect each other. For example, in the case where a partition 22 that extends in the front-rear direction and a partition 22 that extends in the left-right direction are provided, the partitions 22 may intersect each other and form a cross shape in plan view.

In the above-described embodiment, the chamber portion 42B which is one part of the oil suction pipe 42 of the oil pump 40 has a structure that includes a portion that extends inside of the communication groove 27 (cross section), however, in another embodiment, the pump body 41 may have a portion that extends inside the communication groove 27 (cross section). Moreover, with the exception of the oil pump 40, other components and devices arranged inside the oil pan 3 may include a portion that extends inside the communication groove 27 (cross section). That is, a structure body which is formed as a component separate from the oil pan 3 may extend through the inside of the communication groove 27 and narrow the flow path formed by the communication groove 27.

According to an aspect of the present disclosure, an oil circulation device for an internal combustion engine includes an oil pan that is disposed below a cylinder block and that includes a bottom wall and a sidewall that form a recessed portion that opens upward, a partition that extends upward from the bottom wall so as to divide the recessed portion into a first recessed portion and a second recessed portion, and a communication groove that is recessed downward from the protruding end of the partition, that penetrates the partition in the thickness direction, and that enables communication between the first recessed portion and the second recessed portion.

According to this configuration, when oil subjected to an inertial force or the like moves, the amount of movement (displacement) of the oil is reduced because the recessed portion inside the oil pan is divided into a first recessed portion and a second recessed portion. Moreover, because the first recessed portion and the second recessed portion communicate with each other through a communication groove, it is possible for the oil to travel to and fro and the oil is prevented from being maldistributed to one of the first recessed portion and second recessed portion when in a steady state. Moreover, because there is a structure that enables the first recessed portion and the second recessed portion to communicate with each other through the communication groove formed in a partition that divides the first recessed portion and the second recessed portion, an oil pan including the partition and the communication groove can be formed integrally. Moreover, because the communication groove that enables communication between the first recessed portion and the second recessed portion is open upwards, an oil pan including the partition and the communication groove can be formed by press molding of a steel sheet or injection molding of a resin, and manufacturing can be facilitated.

Moreover, the above-mentioned oil circulation device according to the present disclosure may further include an oil pump that pumps oil to each section of the internal combustion engine, and a portion of the bottom wall, namely, a first bottom wall, that corresponds to the first recessed portion is arranged lower than a second bottom wall corresponding to the second recessed portion. The oil pump includes an oil suction mouth that is arranged in the first recessed portion, and the bottom portion of the communication groove is preferably arranged at the same height as the second bottom wall or lower than the second bottom wall.

According to this configuration, the first recessed portion is formed so as to be deeper than the second recessed portion. Moreover, in the case where the oil level in the first recessed portion is lower than the oil level in the second recessed portion, because the oil in the second recessed portion flows along the communication groove to the first recessed portion, the depth of the oil becomes greater in the first recessed portion than in the second recessed portion. Because a suction mouth is arranged in such a first recessed portion, it becomes easy for the suction mouth to remain in the oil.

Moreover, in the above-mentioned oil circulation device of the present disclosure, it is preferable that the second bottom wall have a portion that is inclined downward toward the communication groove.

According to this configuration, because oil on the second bottom wall flows toward the communication groove, the oil in the second recessed portion easily flows into the first recessed portion along the communication groove.

Moreover, in the above-mentioned oil circulation device of the present disclosure, it is preferable that the oil pump include a portion that is received by the communication groove.

According to this configuration, the cross-sectional area through which the oil in the communication groove may pass is reduced by the oil pump. In this way, when the oil in the first recessed portion moves due to a temporary inertial force, centrifugal force, or the like, the amount of oil that flows along the communication groove from the first recessed portion into the second recessed portion is reduced, and the amount of oil remaining in the first recessed portion is increased. Consequently, it is easy for the oil suction mouth to remain in the oil.

Moreover, in the above-described oil circulation device according to the present disclosure, the oil pump may include a pump body and an oil suction pipe that extends from the pump body and has the oil suction mouth at its tip. It is preferable that the oil suction pipe have a portion that extends inside the communication groove.

According to this configuration, the oil suction pipe, which is a pipe, relatively easily passes through the communication groove and can markedly reduce the cross-sectional area through which the oil in the communication groove may pass.

Moreover, in the above-described oil circulation device of the present disclosure, it is preferable that an oil filter screen be provided inside the oil suction pipe.

According to this configuration, the oil suction pipe constitutes a strainer.

Moreover, in the above-mentioned oil circulation device of the present disclosure, it is preferable that the pump body be arranged in the second recessed portion.

According to this configuration, because the pump body is arranged in the second recessed portion which is arranged higher than the first recessed portion, the amount of oil which can be stored in the first recessed portion is increased and it is easy to keep the oil suction mouth inside the oil.

Moreover, in the above-mentioned oil circulation device of the present disclosure, it is preferable that the pump body have a portion that is received inside the communication groove.

According to this configuration, the cross-sectional area through which the oil in the communication groove may pass is reduced by the pump body.

Moreover, in the above-mentioned oil circulation device of the present disclosure, it is preferable that the partition be an upward projection and be formed of a partition outer portion that forms a hollow portion that opens downward toward the inner side, and that the communication groove have a downward projecting shape and be formed of a communication groove outer portion that crosses the partition outer portion.

According to this configuration, because the partition outer portion and the communication groove outer portion have a structure in which the oil pan bottom wall is bent, the rigidity of the oil pan can be increased. The communication groove outer portion reduces the deformation that occurs in the partition outer portion in the thickness direction of the partition.

According to the above configuration, it is possible to reduce displacement of oil in an oil pan and facilitate manufacturing of an oil circulation device of an internal combustion engine.

Obviously, numerous modifications and variations of the present invention are possible in light of the above teachings. It is therefore to be understood that within the scope of the appended claims, the invention may be practiced otherwise than as specifically described herein.

What is claimed is:

1. An oil circulation device for an internal combustion engine, comprising:

an oil pan that is configured to be disposed below a cylinder block and that includes a bottom wall and a sidewall that form a recessed portion that opens upward;

a partition that extends upward from the bottom wall so as to divide the recessed portion into a first recessed portion and a second recessed portion;

an oil pump configured to pump oil to the internal combustion engine; and a communication groove that is recessed downward from a protruding end of the partition, that penetrates the partition in the thickness direction, and that enables communication between the first recessed portion and the second recessed portion, wherein the communication groove has a cross-section with a width that narrows from an upper opening portion located at the protruding end of the partition to a bottom portion located at a bottom side of the communication groove, and wherein the oil pump includes a portion that protrudes vertically downward from an area directly above the upper opening portion of the communication groove through the upper opening portion into the communication groove to a height below the protruding end of the partition.

2. The oil circulation device according to claim 1, further comprising:

the oil pump is configured to pump oil to each section of the internal combustion engine, wherein, in the bottom wall, a first bottom wall corresponding to the first recessed portion is arranged lower than a second bottom wall corresponding to the second recessed portion, the oil pump includes an oil suction mouth arranged in the first recessed portion, and a bottom portion of the communication groove is arranged at the same height as the second bottom wall or is arranged lower than the second bottom wall.

3. The oil circulation device according to claim 2, wherein the second bottom wall has a portion that is inclined downward toward the communication groove.

4. The oil circulation device according to claim 2, wherein, the oil pump includes a pump body and an oil suction pipe that extends from the pump body and that has an oil suction mouth at a tip of the oil suction pipe, and the oil suction pipe includes a portion that extends inside the communication groove.

5. The oil circulation device according to claim 4, wherein, an oil filter screen is provided inside the oil suction pipe.

6. The oil circulation device according to claim 4, wherein the pump body is arranged in the second recessed portion.

7. The oil circulation device according to claim 6, wherein, the pump body includes a portion that is received inside the communication groove.

8. The oil circulation device according to claim 1, wherein the partition is an upward projection, and is formed of a partition outer portion that forms a hollow portion that opens downward toward the inner side, and the communication groove has a downward projecting shape and is formed of a communication groove outer portion that crosses the partition outer portion.

9. An oil circulation device for an internal combustion engine, comprising:

an oil pan that is configured to be disposed below a cylinder block and that includes a bottom wall and a sidewall to define a recessed portion that opens upward;

a partition extending upward from the bottom wall so as to have a protruding end and divide the recessed portion into a first recessed portion and a second recessed portion;

a communication groove extending downward from the protruding end of the partition in a thickness direction of the partition to connect the first recessed portion and the second recessed portion; and an oil pump configured to pump oil to the internal combustion engine, wherein the communication groove has a cross-section that is formed as an inverted triangle that tapers downward, and wherein the oil pump includes a portion that protrudes vertically downward from an area directly above the inverted triangle of the communication groove into the communication groove to a height below the protruding end of the partition.

10. The oil circulation device according to claim 9, further comprising:

the oil pump is configured to pump oil to each section of the internal combustion engine, wherein, in the bottom wall, a first bottom wall corresponding to the first recessed portion is arranged lower than a second bottom wall corresponding to the second recessed portion, wherein the oil pump includes an oil suction mouth arranged in the first recessed portion, and wherein a bottom portion of the communication groove is arranged at a same height as the second bottom wall or is arranged lower than the second bottom wall.

11. The oil circulation device according to claim 10, wherein the second bottom wall has a portion that is inclined downward toward the communication groove.

12. The oil circulation device according to claim 10, wherein the oil pump includes a pump body and an oil suction pipe that extends from the pump body and that has the oil suction mouth at a tip of the oil suction pipe, and wherein the oil suction pipe includes a portion that extends inside the communication groove.

13. The oil circulation device according to claim 12, wherein an oil filter screen is provided inside the oil suction pipe.

14. The oil circulation device according to claim 12, wherein the pump body is arranged in the second recessed portion.

15. The oil circulation device according to claim 14, wherein the pump body includes a portion that is received inside the communication groove.

16. The oil circulation device according to claim 9, wherein the partition has an upward projecting shape, and is made of a partition outer portion that defines a hollow portion that opens downward toward an inner side of the partition, and wherein the communication groove has a downward projecting shape and is made of a communication groove outer portion that crosses the partition outer portion.

17. The oil circulation device according to claim 10, wherein the bottom portion of the communication groove is inclined downward from the second bottom wall to the first bottom wall.

18. The oil circulation device according to claim 13, wherein the oil suction pipe contains two materials which are fixed to each other, and wherein the oil filter screen is sandwiched between the two materials.

* * * * *